United States Patent [19]

Larsen

[11] 4,407,606

[45] Oct. 4, 1983

[54] METHOD AND APPARATUS FOR PRODUCING AND LAYING A BALLASTED MAT FOR GROUND STABILIZATION

[76] Inventor: Ole J. F. Larsen, P.O. Box 3002, 6700 Esbjerg, Denmark

[21] Appl. No.: 285,078

[22] PCT Filed: Nov. 12, 1980

[86] PCT No.: PCT/DK80/00068

§ 371 Date: Jul. 8, 1981

§ 102(e) Date: Jul. 8, 1981

[87] PCT Pub. No.: WO81/01432

PCT Pub. Date: May 28, 1981

[30] Foreign Application Priority Data

Nov. 13, 1979 [GB] United Kingdom ..... 7939278

[51] Int. Cl.[3] ..... E02B 3/12

[52] U.S. Cl. ..... 405/17; 405/157; 405/16

[58] Field of Search ..... 405/172, 157, 16, 17, 405/18, 19, 20, 1

[56] References Cited

U.S. PATENT DOCUMENTS

| | | | |
|---|---|---|---|
| 1,956,967 | 5/1934 | Upson | 405/17 |
| 4,077,222 | 3/1978 | Larsen | 405/16 |
| 4,338,043 | 7/1982 | Biancale et al. | 405/172 |

FOREIGN PATENT DOCUMENTS

| | | | |
|---|---|---|---|
| 1189156 | 9/1959 | France | 405/19 |
| 6711308 | 2/1968 | Netherlands | 405/16 |
| 756196 | 8/1956 | United Kingdom | 405/19 |

*Primary Examiner*—Dennis L. Taylor
*Assistant Examiner*—John A. Gungor
*Attorney, Agent, or Firm*—Diller, Ramik & Wight

[57] ABSTRACT

The disclosure relates to a method of producing and laying on the ground a ballasted mat defined by two layers of sheet material joined together along parallel lines and enclosing particulate ballast material by providing two sources of sheet material and continuously drawing the sheet material from the sources under the influence of the ballasted mat, continuously leading the sheet material to meet in generally overlapped relationship, seaming the sheet material to enclose at least two parallel compartments, continuously filling the two parallel compartments with particulate ballast material, continuously advancing the sources of sheet material over the ground adapted to be covered by the ballasted mat, continuously lowering the ballasted mat to the ground during the formation thereof and during the advancing of the sources of sheet material in timed relationship to the drawing of the sheet material from the two sheet material sources, and seaming cross-wise the end of each ballasted mat and the adjacent end of the next ballasted mat.

4 Claims, 7 Drawing Figures

METHOD AND APPARATUS FOR PRODUCING AND LAYING A BALLASTED MAT FOR GROUND STABILIZATION

TECHNICAL FIELD

The invention relates to the forming and installing of a ballasted mat for stabilization of the ground. Typical applications of the invention are: Prevention or control of scour along submarine pipelines and also ballasting of these, shore and river bank protection, prevention of shoaling up of navigational channels, stabilization of the ground under roads, prevention of land slides, and the like.

BACKGROUND ART

Several means have been devised for fixing the soil or for covering it. However, these present solutions often are of relatively high cost and are somewhat complex in construction while not always giving the desired protective results.

For anchoring of underwater pipelines a continuous dumbbell tube system is disclosed by the Murphy U.S. Pat. No. 3,779,027. However, this tube system extends only a short distance away from the pipeline and thereby has too narrow width to prevent undermining of the pipeline. Furthermore, the filling of the tubular envelope with ballast material takes place after the tubular envelope has been installed over the pipeline. This method of filling which does not utilize gravity cannot and is not supposed to totally fill out the cross-section of the tube.

Similar disadvantages has the Keith U.S. Pat. No. 3,793,845.

Another existing, so called Gabion system is used for shore protection, harbour construction, road construction, and the like. The area to be stabilized is covered with separate side-by-side boxes of wire mesh which are filled manually with stones. Because of the large required volume of stones and the extensive use of labour work involved, this system is very expensive.

DISCLOSURE OF INVENTION

It is therefore an object of the present invention to provide a method and apparatus for producing and laying a ballasted mat for ground stabilization which will overcome the inherent limitations and disadvantages of the known prior systems.

It is another object of the present invention to provide a ballasted mat having an economical cost per unit area factor.

Depending on the purpose of the mat, the mat-producing machine is mounted either on a vehicle, e g supplied with caterpillars fit for moving on land, or on a surface vessel or on a platform supplied with movable legs by means of which the platform can "walk", or on a underwater vehicle, e g supported on and driven forward by longitudinally extending rotating tubes supplied with screw threads on their outer surfaces.

The sheet material used for forming the mat preferably is provided in two opposite rolls, each having the proper width, or alternatively, in more, shorter rolls. The material from either roll is fed through a system of parallel, adjacent rollers which spread out the sheets and by means of brakes control the speed of laying the mat.

A certain distance below the last roller which either sheet passes over, the sheet is seamed together with the other sheet by means of a row of horizontally spaced seaming devices. Hereby a continuous mat containing vertical parallel compartments like those of a ribbed eider down is formed.

Particulate matter forming ballast is simultaneously fed through pipes or hoses between the seaming devices into the compartments of the mat. The lower ends of the hoses or pipes are below the seaming devices, but above the ground, so that the weight of the ballast continuously pulls the mat down to the ground, as the mat-forming machine is continuously advanced.

At the completion of the section of mat, the compartments of the mat are closed by seaming crosswise the end of the section in a horizontal line below the lower ends of the hoses or pipes. A parallel seam a little distance above this first seam is produced to close the foremost end of the next section of mat to be produced, and finally the mat is cut between the two seams.

BRIEF DESCRIPTION OF DRAWINGS

While the fields of application of the present invention cover uses above as well as under water, a full and complete understanding of the invention may be had by reference to the description of preferred embodiments relating to one example: protection of submarine pipelines as set forth hereinafter and as may be seen in the accompanying drawings in which.

BEST MODE OF CARRYING OUT THE INVENTION

Figure 1:
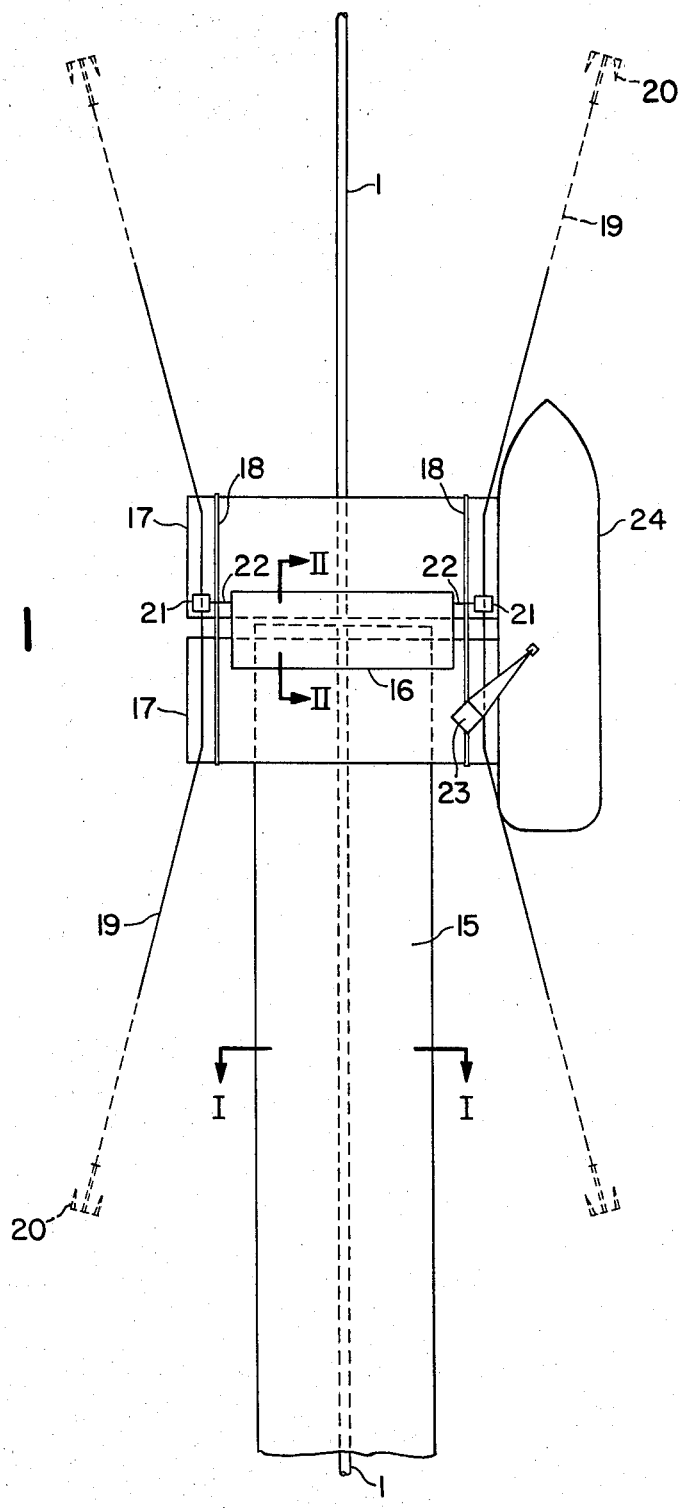
FIG. 1 is a plan view of the mat-forming system of the present invention and shows the system mounted on a surface vessel and continuously forming and laying the mat over the pipeline.
Figure 2:
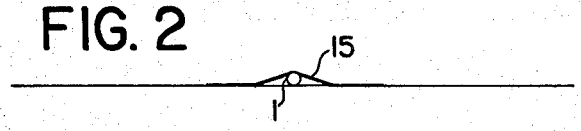
FIG. 2 is a cross-section taken along the line I—I in FIG. 1 and shows the pipeline covered by the mat.

Referring to FIGS. 1-6 of the drawings, there is depicted an apparatus 16 of the present invention for forming and installing a ballasted mat 15 over a pipeline 1. 16 is mounted on a sea going vessel which may be in the form of a barge out over the side of which 16 is overhanging, or in the form of a barge supplied with a moonpool through which 15 can pass on its way to the seabed, or in the form of two barges 17 coupled together by means of beams 18 on the over- and/or underside of 17.

The vessel 17 may be moved forwards by means of winches 21 pulling the vessel along the warps 19 which are anchored to warp anchors 20.

The vessel 17 may include compartments for storing a particulate ballast material 3 and sheet material 2 utilized in forming the mat 15. Both kinds of material may be transported from shore to the vessel by supply boats 24 and unloaded by a crane 23.

The ballast material 3 may comprise any suitable weighty particulate material such as stones, pebbles, sand, pieces of concrete and the like. The grain size must be larger than the size of any perforation of the sheet material 2, but smaller than about ⅓ of the diameter of the hoses or pipes 8. Otherwise the ballast material may get stuck in the hoses or pipes.

The sheet material 2 may be a continuous, woven or extruded sheet consisting for instance of plastic or natural fibres resistant to the eroding and deteriorating factors of the environment. Alternatively, it may be a net, in which the mesh width is smaller than the grain size of the ballast material 3. The net may be made of plastic, natural fibres, aluminium or steel which may be galvanized and/or coated with plastic.

The two layers of sheet 2 forming the mat 15 may be made of the same material or two different kinds of material, they may have different mesh widths and other differences. For example, in the cross-section of the mat shown in FIG. 5 the straight sheet 30 may be a coated steel wire mesh or a strong plastic net, e g reinforced with aromatic polyamide, and the buckled sheet 31 may be a thinner or weaker net made for instance of plastic.

The rolls 10 supported on bearing rollers 13 feed the sheet material 2 to the seaming devices 4 via a suitable number of rollers, for instance three: 5, 6 and 7. The functions of the rollers are to stretch out the sheet in its transverse direction and to control the speed of laying of the mat. If for instance the sheet material is a plastic net and therefore is very elastic, its width has a tendency to contract because of the longitudinal drag force due to the weight of the ballast 3. To counteract such tendency of a sheet 30 which is supposed to be straightened out when it leaves the roller 5, one of the rollers, e g 7, on its surface may be supplied with two screw threads 25. Either threads occupies half of the length of the roller 7, and the two threads have opposite directions of pitch. The surface of the roller 7 turns in the direction 32 against the direction 33 of movement of the sheet 2, and when 7 rotates, either screw threads tends to stretch out the sheet 2 in direction away from the middle of the roller 7 toward the outer end of the thread.

The surfaces of the rollers 6 and 5 turn in the same direction as the directon of movement of the sheet 2. The surface of at least the roller 5, which carries the weight of the suspended length of the mat 15, has a high frictional resistance, obtained for instance by means of the raised edges of longitudinally extending slits cuts in a steel plate cylinder making up the surface of 5.

The roller 6 may be supported in slide bearings and by means of spring or rubber means continuously pressed against 5. The weight of 15 thereby is carried by the rollers 5; and by brake means acting on the periphery or the axle of 5, the speed of descending the mat can be controlled.

Figure 3:
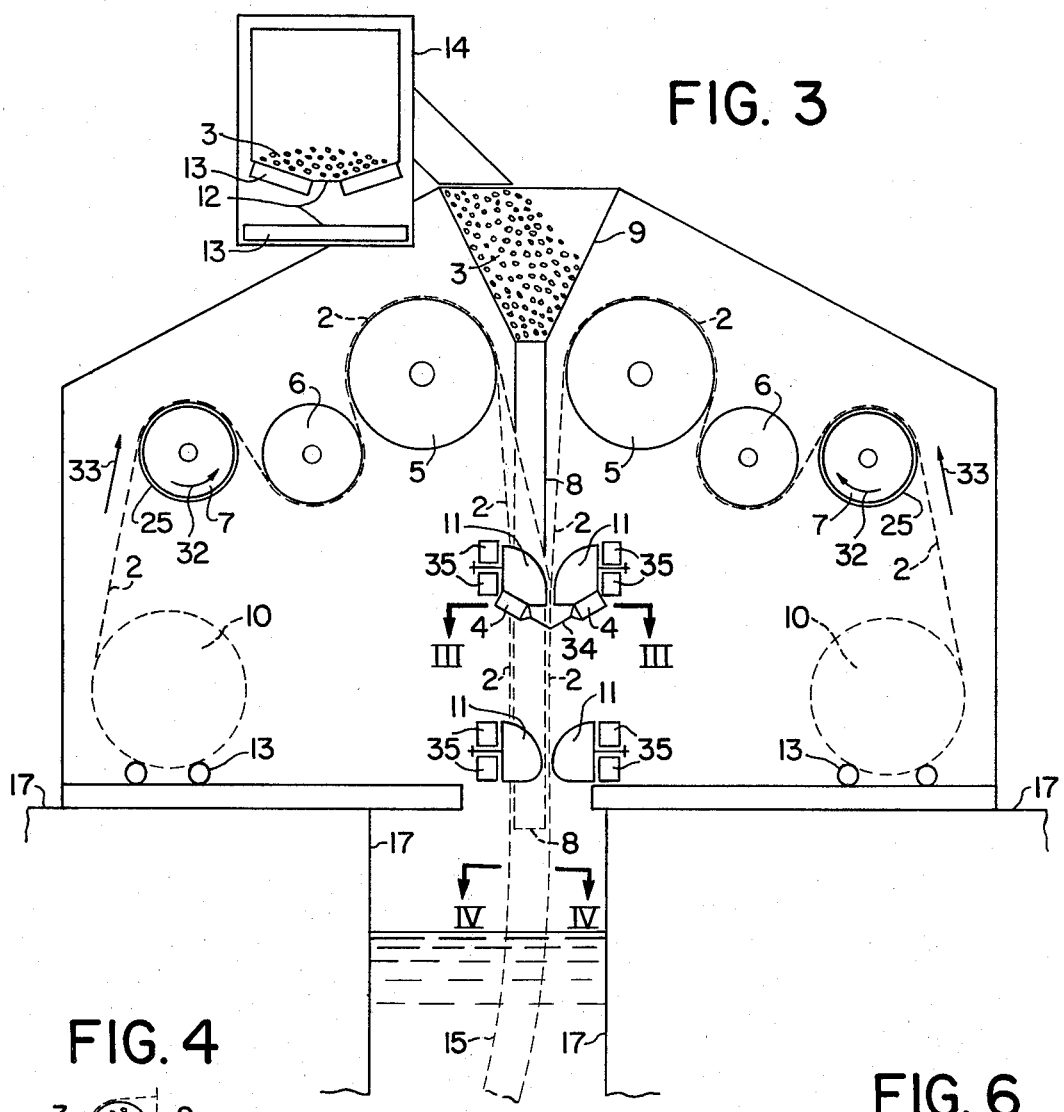
FIG. 3 is an enlarged cross-section taken along the line II—II in FIG. 1 and shows a schematic cross-section of the mat-forming and -laying system.
Figure 4:
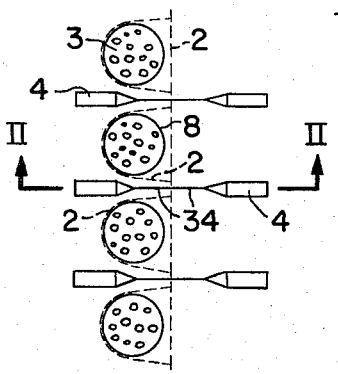
FIG. 4 is an enlarged cross-section taken along the line III—III in FIG. 3.
Figure 5:
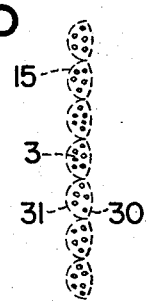
FIG. 5 is a cross-section taken along the line IV—IV in FIG. 3 of the completed mat.
Figure 6:
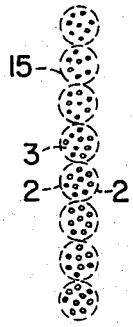
FIG. 6 is a cross-section of an alternative shape of the mat.

At a suitable level below 5, guiding members 11 make the two sheets meet, so that the sheets can be seamed together in each line between the upper and lower parts of each guiding member 11. The members 11 may be vertical plates as shown in the drawing, and should have thickness corresponding to the width of the seaming devices 4. Depending on the desired contour of the cross-section of the mat, the guiding edges of the members 11 are placed in line with the centerlines of the hoses or pipes 8, cf. FIG. 6, or asymmetrically as shown in FIG. 3. In the latter case the seams of the mat, FIG. 5, become less strained by the ballast during and after laying of the mat.

Preferably the guiding members 11 are mounted slidably on horizontal beams 35, so that their mutual spacing can be regulated in accordance with the desired thickness of the mat.

The seams may be continuous, so that completely separated tube-like compartments between the two sheets 2 are formed. Aternatively, the seaming process may be stopped at intervals, while the sheets continue on their way downwards, whereby the resulting connections between the compartments are left open. The intervals may be staggered between neighboring seams.

The seaming together of the two sheets 2 is effected by means of well-known seaming devices 4. These devices may be in the form of heating means, if plastic sheet material is being utilized. Alternatively, seaming means may be in the form of any suitable apparatus for sewing, stapling or gluing the sheets together, so that sufficiently strong joints are produced with lasting qualities for the environment within which the mat will be placed.

If the sheets 2 are nets with sufficiently large mesh widths, the well-known seaming devices 4 schematically shown in FIG. 3 may be appropriate. Each device includes an electrically heated melt of polyester which is pumped through a nozzle so that a squirt 34 is formed. If in each line to be seamed two opposite devices 4 pump squirts 34 against each other, preferably under an angle, the two squirts will fuse in the openings between the threads of the pets 2 and embrace the threads on their outward sides, so that a continuous, strong seam is formed.

The lower row or parts of the guiding members 11 are placed so far below the seaming devices 4 that the melted polyester gets time enough to harden before it reaches the lower row or parts of the guiding members.

The crosswise seaming of the end of each section of mat appropriately may be done by means of stapling means.

Between the guiding members 11, hoses or pipes 8 lead the ballast material 3 into the continuous compartments formed between the two sheets 2. The lower ends of 8 are below the lower guiding members 11, but above the ground, so that gravity can be utilized.

An even distribution of the ballast material 3 over all of the width of the mat 15 may be obtained by means of a well-known distribution plant 9, 12, 13 and 14. 9 is a horizontal tank to the perforated bottom of which the hoses or pipes 8 are attached. A conveyor belt 12 on bearing rollers 13 transports the ballast material 3 from a filling station at the end of the belt, and a car 14 on tracks, driven by the belt 12, moves to and fro and distributes the ballast material over the entire length of tank 9.

In some cases an uneven distribution is desirable. For example, in a mat consisting of two layers of net for covering a submarine pipeline, the net openings allowing for flow through the centre portion of the mat may be kept open. Such uneven distribution may be obtained by regulating the supply of ballast material from the filling station and/or from the car 14, and/or by closing more or less the centre hoses or pipes 8.

The speed of laying the mat 15 must be correlated with the speed of the surface vessel 17 and with the speed of supply of the ballast material 3. This correlation may be obtained by manual regulation. Alternatively, the said three speeds may be correlated by means of mechanical couplings 22 between the winches 21 and the rollers 5 and the conveyor belt 12, or between two or these three components, only.

INDUSTRIAL APPLICABILITY

In the above-mentioned fields of application of the invention the mat 15 normally is placed directly on the ground above or under water.

Besides this way of applying the mat, it may be used for construction of a barrier on land or in a body of water. Examples are: Road or railway construction, sea or river dikes, submarine barriers for coastal protection or prevention of siltation in water ways, and the like.

Figure 7:
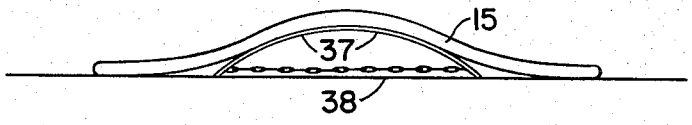
FIG. 7 is a schematic cross-section of a submarine barrier involving use of the present type of mat.

The core of the barrier may be solid and consist of fill material such as sand, gravel or other granular material. Or it may consist of a shell-formed structure 37 forming at least part of the desired cross-section of the barrier, cf. FIG. 7. The surface of the barrier is made up of a the ballasted mat 15. In submarine barriers the mat protects the core against undermining and adds weight to prevent removal of the barrier due to waves and currents.

The structure 37, for example, may consist of concrete, plastic, wood or metal. The symmetrical side portions of 37 may be hinged or rigidly interconnected, and their lower edges may be interconnected by horizontal ties 38. The structure 37 may be a continuous plate, which may be provided with apertures allowing for vertical flow of water. Alternatively, the structure may be made up of separate or interconnected transversely extending supporting members perpendicular or oblique to the longitudinal direction of the barrier. The structure 37 may be attached to the mat 15, before the mat is laid.

I claim:

1. A method of producing and laying on the ground a ballasted mat defined by two layers of sheet material joined together along parallel lines and enclosing particulate ballast material comprising the steps of providing two sources of sheet material, continuously drawing the sheet material from the two sheet material sources under the influence of the ballasted mat, continuously leading the sheet material to meet in generally overlapped relationship, seaming the sheet material to enclose at least two parallel compartments, continuously filling the two parallel compartments with particulate ballast material, continuously advancing the sources of sheet material over the ground adapted to be covered by the ballasted mat, continuously lowering the ballasted mat to the ground during the formation thereof and during the advancing of the sources of sheet material in timed relationship to the drawing of the sheet material from the two sheet material sources, and seaming crosswise the end of each ballasted mat and the adjacent end of the next ballasted mat.

2. The method as defined in claim 1 wherein the seaming of the sheet material to enclose at least two parallel compartments is done continuously.

3. The method as defined in claim 1 wherein the seaming of the sheet material to enclose at least two parallel compartments is done interruptedly.

4. The method as defined in claim 1 including the step of placing a core on the ground and the step of lowering the ballasted mat to the ground includes the step of overlying the ballasted mat upon the core, thereby forming a barrier.

* * * * *